US011326599B2

(12) United States Patent
Cho et al.

(10) Patent No.: US 11,326,599 B2
(45) Date of Patent: May 10, 2022

(54) COMPRESSOR HAVING SURFACE OF SCROLL COMPRESSOR DEFINING BOUNDARY OF INLET AND SURFACE GUIDE DEFINING BOUNDARY OF VENT FACING EACH OTHER AND ELECTRONIC DEVICE USING THE SAME

(71) Applicant: Samsung Electronics Co., Ltd., Suwon-si (KR)

(72) Inventors: Sunghea Cho, Suwon-si (KR); Eunsuk Kim, Suwon-si (KR); Junghoon Park, Suwon-si (KR); Jongcheun Seo, Suwon-si (KR); Namkyu Cho, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 72 days.

(21) Appl. No.: 16/689,350

(22) Filed: Nov. 20, 2019

(65) Prior Publication Data

US 2020/0158110 A1 May 21, 2020

(30) Foreign Application Priority Data

Nov. 20, 2018 (KR) ..... 10-2018-0143218

(51) Int. Cl.
*F04C 18/02* (2006.01)
*F04C 29/12* (2006.01)

(52) U.S. Cl.
CPC ..... *F04C 18/0215* (2013.01); *F04C 18/0261* (2013.01); *F04C 29/12* (2013.01);
(Continued)

(58) Field of Classification Search
CPC ..... F01C 1/0207–0292; F04C 2/025; F04C 18/0207–0292; F04C 2230/602–604;
(Continued)

(56) References Cited

U.S. PATENT DOCUMENTS 7,316,549 B2 1/2008 Kim et al.
9,366,462 B2 6/2016 Perevozchikov et al.
(Continued)

FOREIGN PATENT DOCUMENTS

CN 1840909 A 10/2006
CN 101223364 A 7/2008
(Continued)

OTHER PUBLICATIONS

Office Action dated Jun. 9, 2021 in Chinese Application No. 201911134853.3.
(Continued)

*Primary Examiner* — Laert Dounis
(74) *Attorney, Agent, or Firm* — Staas & Halsey LLP

(57) ABSTRACT

A compressor including a compression unit comprising an inlet for sucking gas and configured to compress the sucked gas; and a casing configured to accommodate the compression unit; and a suction guide comprising a passage for guiding the gas from an outside of the casing to the inlet. The compression unit includes a first surface extending from an edge of the inlet, the suction guide includes a second surface extending from an edge of a vent of the passage, and provided in an internal area of the casing to make the first surface and the second surface face each other, and an external end of the first surface and an internal end of the second surface or an internal end of the first surface and an external end of the second surface do not overlap along a direction of an axis of the compressor.

16 Claims, 15 Drawing Sheets

(52) U.S. Cl.
CPC .... *F04C 2230/231* (2013.01); *F04C 2230/60* (2013.01); *F04C 2230/603* (2013.01); *F04C 2240/30* (2013.01); *F04C 2240/805* (2013.01); *F04C 2250/101* (2013.01)

(58) Field of Classification Search
CPC ..... F04C 29/12; F04C 2240/30; F04C 2240/806; F04C 2250/101; F04B 39/12; F04B 39/123
See application file for complete search history.

(56) References Cited

U.S. PATENT DOCUMENTS

2001/0055536 A1* 12/2001 Bernardi ..... F04C 29/12 418/55.6
2004/0126258 A1* 7/2004 Lai ..... F04C 29/045 418/55.1
2006/0177332 A1 8/2006 Kim et al.
2006/0222550 A1 10/2006 Shin et al.
2007/0183914 A1* 8/2007 Gopinathan ..... F04C 18/0215 418/55.5
2009/0035168 A1 2/2009 Ginies et al.
2009/0229303 A1* 9/2009 Iversen ..... F04B 39/123 62/500
2014/0069139 A1* 3/2014 Perevozchikov ... F04C 18/0215 62/505
2020/0109711 A1* 4/2020 Futagami ..... F04C 18/0215

FOREIGN PATENT DOCUMENTS

CN 104619987 A 5/2015
KR 20010015515 A * 2/2001
KR 20080019509 A * 3/2008
KR 10-1462943 11/2014
KR 10-2015-0081691 7/2015

OTHER PUBLICATIONS

Office Action dated Jan. 18, 2022 in Chinese Application No. 201911134853.3.

* cited by examiner

COMPRESSOR HAVING SURFACE OF SCROLL COMPRESSOR DEFINING BOUNDARY OF INLET AND SURFACE GUIDE DEFINING BOUNDARY OF VENT FACING EACH OTHER AND ELECTRONIC DEVICE USING THE SAME

CROSS-REFERENCE TO RELATED APPLICATIONS

This application is based on and claims priority under 35 U.S.C. § 119 to Korean Patent Application No. 10-2018-0143218 filed on Nov. 20, 2018 in the Korean Intellectual Property Office, the disclosure of which is incorporated by reference herein in its entirety.

BACKGROUND

1. Field

The disclosure relates to an electronic device using a compressor, such as an air conditioner, a refrigerator, and a freezer, and more particularly, to a sealed compressor including a suction guide which guides gas from an outside of a casing to an inlet of a compression unit.

2. Description of the Related Art

A compressor refers to a mechanical device which increases pressure of gas by compressing the gas. Compressors are classified into a reciprocating type and a rotary type according to operating principles. In a reciprocating-type compressor, a rotary motion of a motor is converted into a linear reciprocating motion of a piston in a cylinder through a crank shaft and a connecting rod so that gas can be sucked and compressed. As rotary-type compressors, there are a rotary compressor which sucks and compresses gas while a roller rotates in a cylinder due to a rotary motion of a motor, and a scroll compressor which continuously sucks and compresses gas while a rotating scroll is rolled in a predetermined direction with respect to a stationary scroll due to a rotary motion of a motor.

The scroll compressor includes a compression unit including a stationary scroll and an rotating scroll, a motor for rolling the rotating scroll of the compression unit, a casing for hermetically accommodating the compression unit and the motor, and a suction guide having a passage for guiding gas from the outside of the casing to the compression unit. The suction guide is disposed so that an outlet of the casing accommodating the compression unit therein can be aligned with a gas inlet of the stationary scroll. The suction guide is fastened around the gas inlet by screw coupling.

In such a conventional compressor, the inlet of the stationary scroll which comes in contact with the outlet of the suction guide has an irregular shape, and thus the outlet of the suction guide also has a complex shape. To commercialize the suction guide having the complicated outlet, the suction guide is generally manufactured with plastic by injection molding. Further, the suction guide is coupled to the fixed scroll to minimize a gap at contact points when assembled. Because the injection-molded plastic has low mechanical strength, the suction guide is likely to be damaged when assembled or operating. In terms of design, the complex structure of the suction guide limits a gas passage, causing reduction in a cross-sectional area and degradation in a compression efficiency. In particular, when the compression unit is being inserted in the casing, it is not easy to couple the suction guide to the stationary scroll because a space between the compression unit and the casing is narrow.

SUMMARY

An aspect of one or more exemplary embodiments is to provide a compressor having a suction guide which has a simple structure and high mechanical strength and showing high compression efficiency, and an electronic device using the compressor.

Another aspect of one or more exemplary embodiments is to provide a method of manufacturing a compressor showing high workability.

According to an embodiment, a compressor is provided. The compressor includes a compression unit comprising an inlet for sucking gas and configured to compress the sucked gas; and a casing configured to accommodate the compression unit; and a suction guide comprising a passage for guiding the gas from an outside of the casing to the inlet, wherein the compression unit includes a first surface extending from an edge of the inlet, the suction guide includes a second surface extending from an edge of a vent of the passage, and provided in an internal area of the casing to make the first surface and the second surface face each other, and an external end of the first surface and an internal end of the second surface or an internal end of the first surface and an external end of the second surface do not overlap along a direction of an axis of the compressor. According to a compressor of the disclosure, it is possible to make the inlet of the compression unit and the vent of a suction guide face each other by simply inserting the compression unit with regard to the suction guide coupled to the casing, thereby not only causing high workability but also simplifying the structure of the suction guide so that the suction guide can be manufactured with metal by press work.

The first surface may radially protrude from the compression unit, thereby forming a simple and independent surface facing the suction guide.

Insertion of the compression unit into the casing in the state that the suction guide is coupled to the casing may be enough to align the inlet of the compression unit with the vent of the suction guide casing.

The suction guide may be coupled to the casing.

The compression unit may be accommodated in the casing in a state that the suction guide is coupled to the casing.

The suction guide may include a guide body; and at least one wing comprising one side supported by the guide body and an opposite side supported by the casing.

The wing may support the guide body to elastically bias the guide body in a direction away from the inlet, thereby coping with a mechanical error and a work error.

The suction guide may include one pair of wings supported by left and right sides of the guide body, thereby facilitating coupling work for the suction guide.

The wing may be welded onto and supported by the casing.

The first surface may include a first taper portion inclined toward the axis at the internal end or the external end, thereby facilitating assembling for the compression unit.

The second surface may include a second taper portion inclined away from the axis at the internal end or the external end, thereby facilitating assembling for the compression unit.

The first surface and the second surface may be provided as single surfaces and interlocked without interference.

The compression unit May include a stationary scroll including a first scroll forming a spiral compression compartment; and a rotating scroll comprising a second scroll inserted in and rotating in the spiral compression compartment.

Each of the stationary scroll and the rotating scroll may include three protruding flanges radially protruding from the axis of the compressor.

The inlet may be positioned between two adjacent protruding flanges of the stationary scroll, and the two protruding flanges may be not positioned in a surface extending from the first surface, so that the compression unit can be put to the suction guide coupled to the casing without interference.

According to an embodiment, a method of manufacturing a compressor is provided. The method of manufacturing the compressor includes providing a compression unit comprising an inlet for sucking gas and compressing the sucked gas; providing a casing for accommodating the compression unit; coupling, to an internal wall of the casing, a suction guide comprising a passage for guiding the gas from an outside of the casing to the inlet; and inserting the compression unit into the casing to make the inlet and a vent face each other.

According to an embodiment, an electronic device including a compressor is provided. The compressor includes a compression unit comprising an inlet for sucking a gas and configured to compress the sucked gas; a casing configured to accommodate the compression unit; and a suction guide comprising a passage for guiding the gas from an outside of the casing to the inlet, wherein the compression unit includes a first surface extending from an edge of the inlet, the suction guide includes a second surface extending from an edge of a vent of the passage, and provided in an internal area of the casing to make the first surface and the second surface face each other, and an external end of the first surface and an internal end of the second surface or an internal end of the first surface and an external end of the second surface do not overlap along a direction of an axis of the compressor.

BRIEF DESCRIPTION OF THE DRAWINGS

The above and/or the aspects will become apparent and more readily appreciated from the following description of exemplary embodiments, taken in conjunction with the accompanying drawings, in which.

DETAILED DESCRIPTION

Hereinafter, a compressor 1 used in an electronic device, such as an air conditioner, a refrigerator, and a freezer, will be described in detail with reference to the accompanying drawings. Embodiments set forth herein describe a sealed scroll compressor 1 to aid in understanding the disclosure. However, the embodiments are exemplary, and it should be understood that the disclosure may be modified and implemented in various ways, such as a sealed rotary compressor and a sealed reciprocating compressor, unlike the embodiments set forth herein. In describing the disclosure below, when a detailed description of an associated well-known function or component unnecessarily obscure the gist of the disclosure, the detailed description will be omitted.

Figure 1:
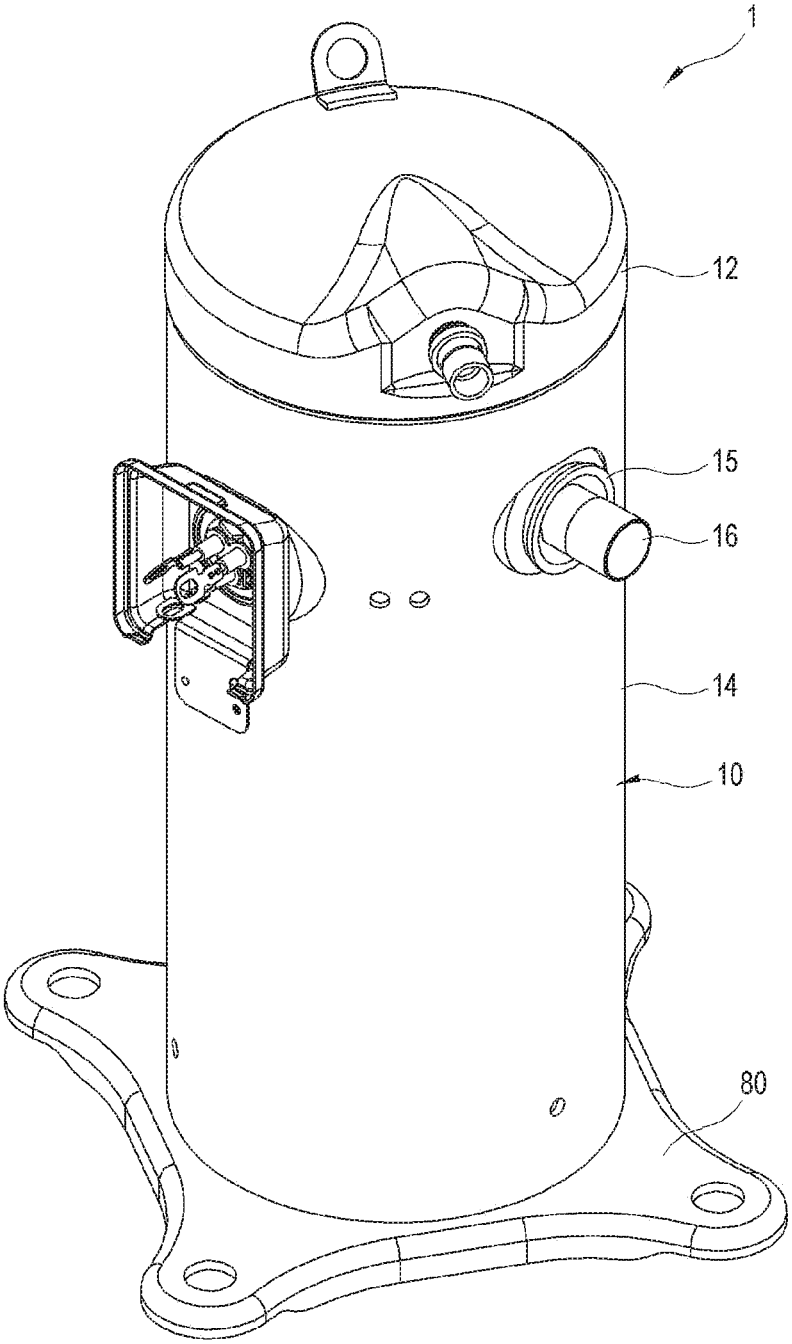
FIG. 1 is a perspective view of a compressor according to a first embodiment of the disclosure.
Figure 2:
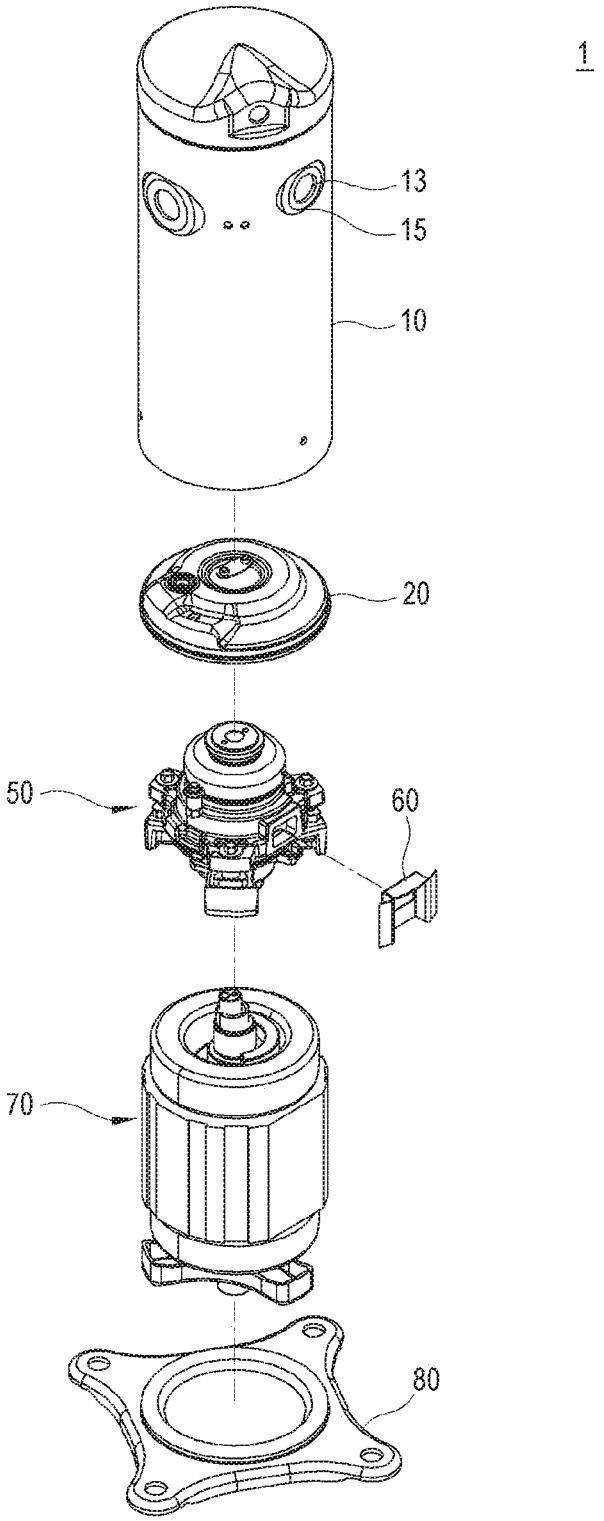
FIG. 2 is an exploded perspective view of the compressor of FIG. 1.
Figure 3:
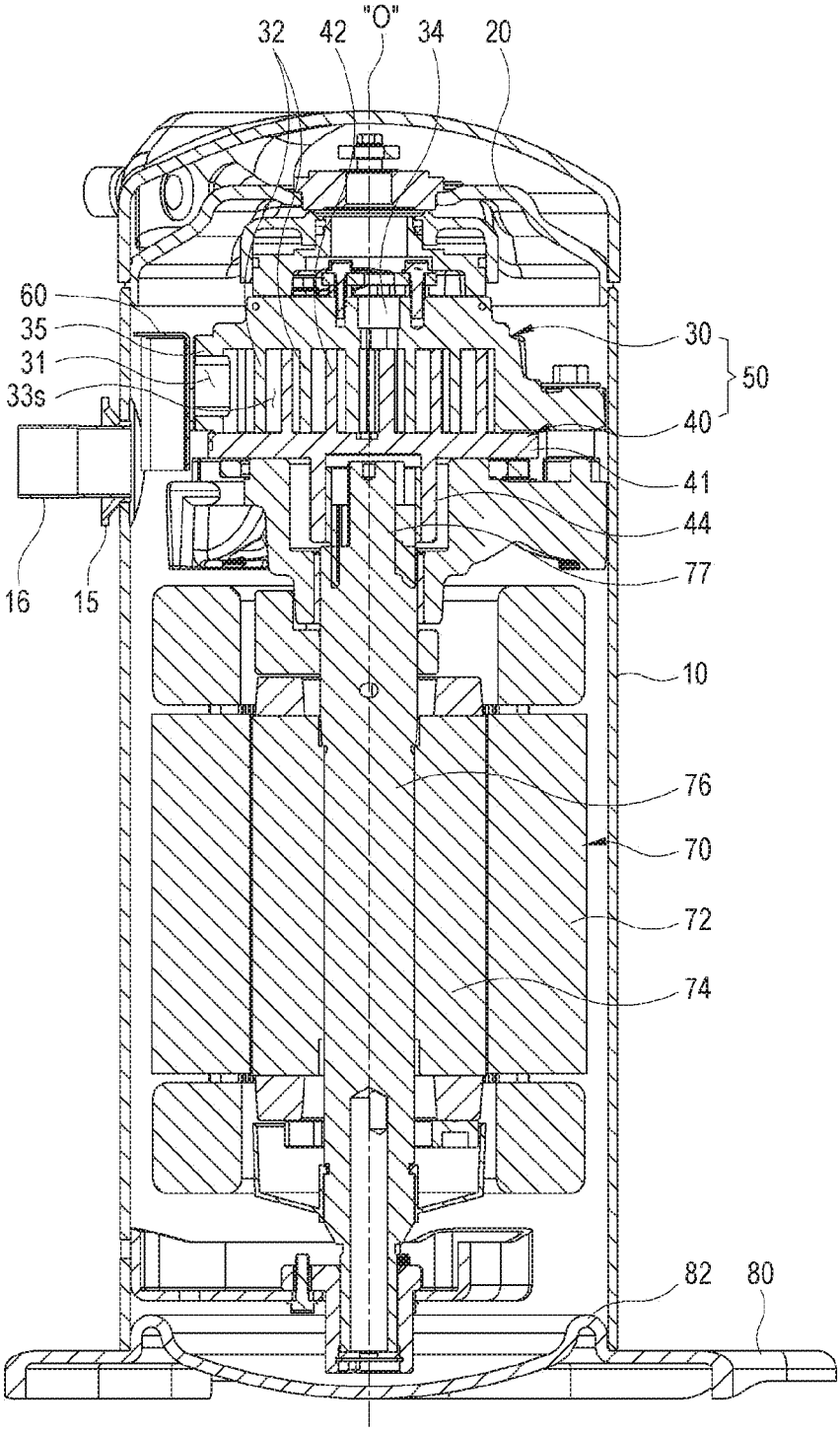
FIG. 3 is a cross-sectional view of the compressor of FIG. 1.

FIGS. 1 to 3 are respectively perspective, exploded perspective, and cross-sectional views of a sealed scroll compressor 1 according to a first embodiment of the disclosure. As shown in the drawings, the compressor 1 includes a casing 10, a discharge cover 20, a compression unit 50, a suction guide 60, a motor 70, and a support 80. The casing 10 accommodates the motor 70 on the internal bottom, the compression unit 50 for receiving dynamic force from the motor 70 and compressing gas, and the discharge cover 20 disposed on the compression unit 50 which are lined up.

The casing 10 is shaped like a cylinder opened downward and includes an upper cover 12 and a cylindrical body 14. The cylindrical body 14 includes a sealer 15 having a tube insertion hole 13 and a gas suction tube 16 put into the tube insertion hole 13.

The discharge cover 20 guides gas, which is compressed in and discharged from the compression unit 50, to be discharged to the outside of the casing 10.

The compression unit 50 compresses sucked gas, for example, a refrigerant, and discharges the compressed gas. The compression unit 50 includes a stationary scroll 30 and a rotating scroll 40 which are coupled to each other.

The stationary scroll 30 has a first scroll 32, which forms a spiral compression compartment 33S spirally extending from the outer portion toward the center having a predetermined width, and a suction portion 35 formed on the circumferential surface. The suction portion 35 has an inlet 31 in which a gas delivered from the suction guide 60 flows. The inlet 31 communicates with the outer portion of the spiral compression compartment 33S.

The rotating scroll 40 includes a plate-shaped base 41, a second scroll 42 protruding in a spiral shape on the upper surface of the base 41, and a shaft coupling unit 44 coupled to the shaft of the motor 70 under the lower surface of the base 41. The rotating scroll 40 rotates with the second scroll 42 inserted in the spiral compression compartment 33S. As the second scroll 42 rotates in the spiral compression compartment 33S, gas sucked into the spiral compression compartment 33S is compressed step by step toward the center and then discharged through an outlet 34.

The suction guide 60 is provided between the inlet 31 of the stationary scroll 30 and the tube insertion hole 13 of the casing 10. The suction guide 60 guides gas from the outside of the casing 10 to the inlet 31 of the stationary scroll 30.

The motor 70 includes a stator 72, a rotor 74, and a rotary shaft 76 coupled to the rotor 74. The rotary shaft 76 includes an eccentric axis unit 77 at an end portion thereof. The eccentric axis unit 77 is coupled to the shaft coupling unit 44 of the rotating scroll 40. The rotating scroll 40 rotates due to the rotation of the eccentric axis unit 77.

The support 80 includes a casing coupling unit 82 which protrudes upward in a ring shape. The casing coupling unit 82 closely contacts and is accommodated in the open lower end of the casing 10 so that the casing 10 can be supported in a standing state.

Figure 4:
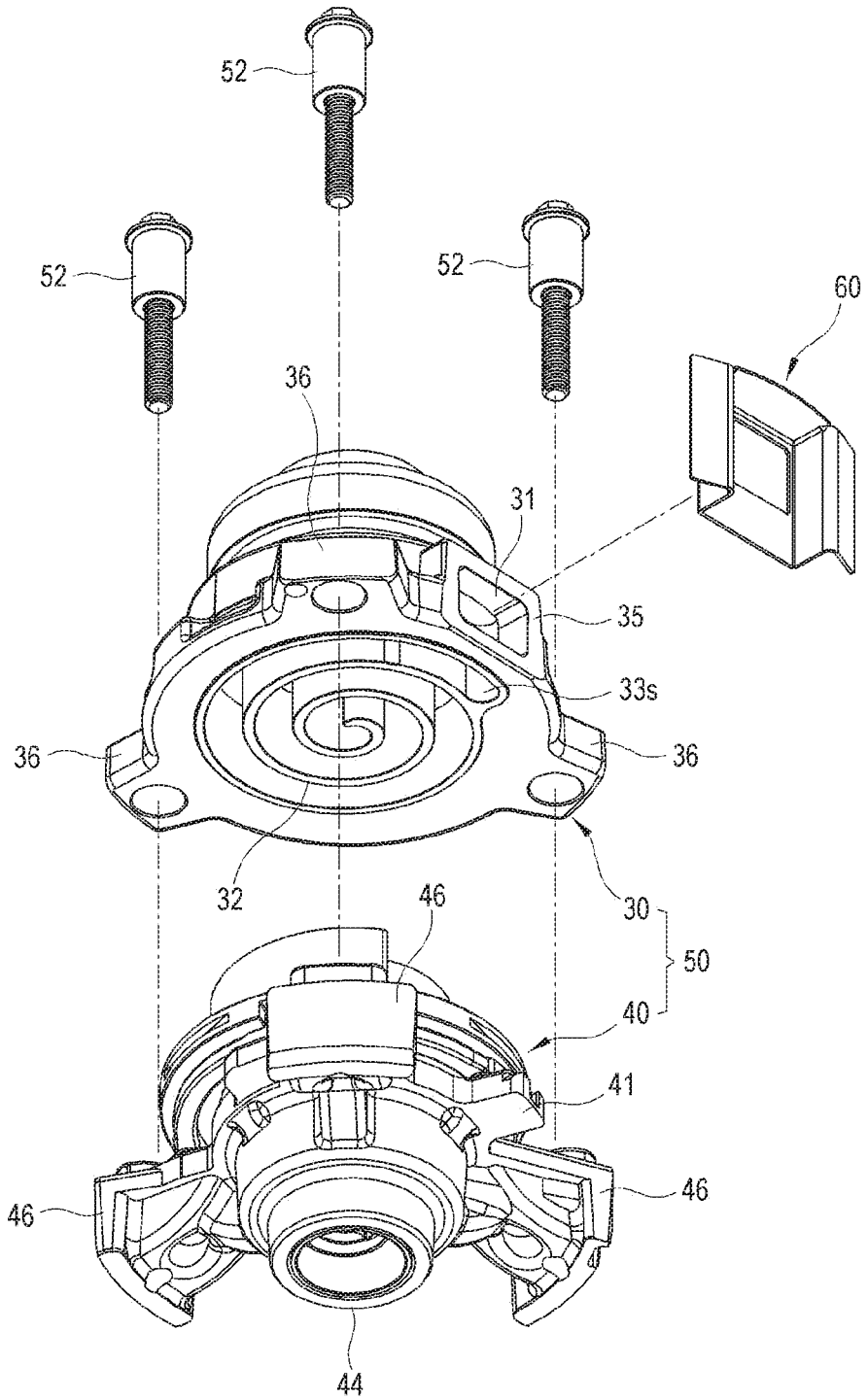
FIGS. 4 and 5 are exploded perspective views of a compression unit of FIG. 2.

The compression unit 50 is described in further detail below with reference to FIGS. 4 and 5. As shown in the drawings, the compression unit 50 includes the stationary scroll 30 and the rotating scroll 40. Each of the stationary scroll 30 and the rotating scroll 40 includes three protruding flanges 36 or 46 which protrude in radial directions. The stationary scroll 30 and the rotating scroll 40 are coupled together through the three protruding flanges 36 and 46 by screws 52.

The stationary scroll 30 includes the first scroll 32, which forms the spiral compression compartment 33S spirally extending from the outside toward the center with the predetermined width, and the suction portion 35 having the inlet 31 leading from the circumferential surface to the external end of the spiral compression compartment 33S. The spiral compression compartment 33S refers to a compression space, of which the center communicates with the outlet 34. Gas sucked through the inlet 31 is delivered to the outer portion of the spiral compression compartment 33S, moved to the center while being compressed in the spiral compression compartment 33S due to the rotation of the rotating scroll 40, which will be described later, and then discharged to the outlet 34.

The rotating scroll 40 includes the plate-shaped base 41, the second scroll 42 extending toward the center in a spiral shape on the upper surface of the base 41, and the shaft coupling unit 44 extending from the lower surface of the base 41 in the axial direction of the compressor. The rotating scroll 40 is coupled to the rotary shaft 76 through the shaft coupling unit 44 and orbits. As a result, when the second scroll 42 rotates in the spiral compression compartment 33S of the stationary scroll 30, gas flowing into the spiral compression compartment 33S through the inlet 31 is moved from the outer unit toward the center while being gradually compressed.

A compression operation of the compressor 1 according to the embodiment of the disclosure will be described below with reference to FIGS. 6 to 9.

Figure 6:
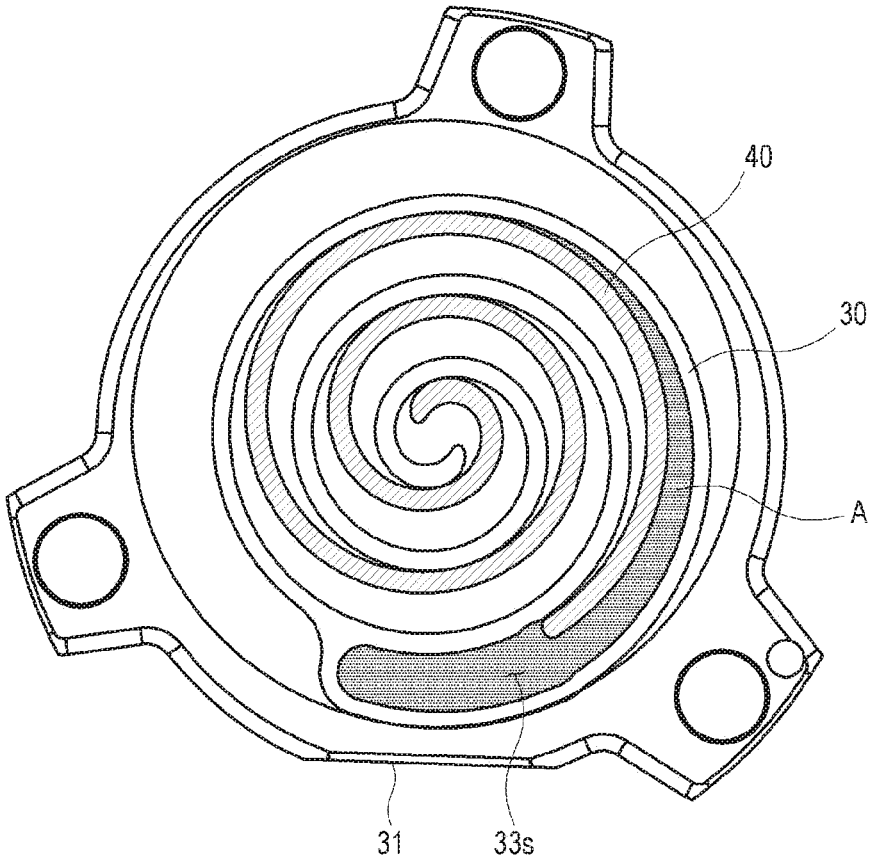
FIGS. 6 to 9 are mimetic views illustrating a gas compression process of a scroll compressor.

In FIG. 6, gas or medium A is sucked into the outer portion of the spiral compression compartment 33S through the inlet 31. The space between the rotating scroll 40 and the stationary scroll 30 is filled with the sucked medium A in the outer portion of the spiral compression compartment 33S.

Figure 7:
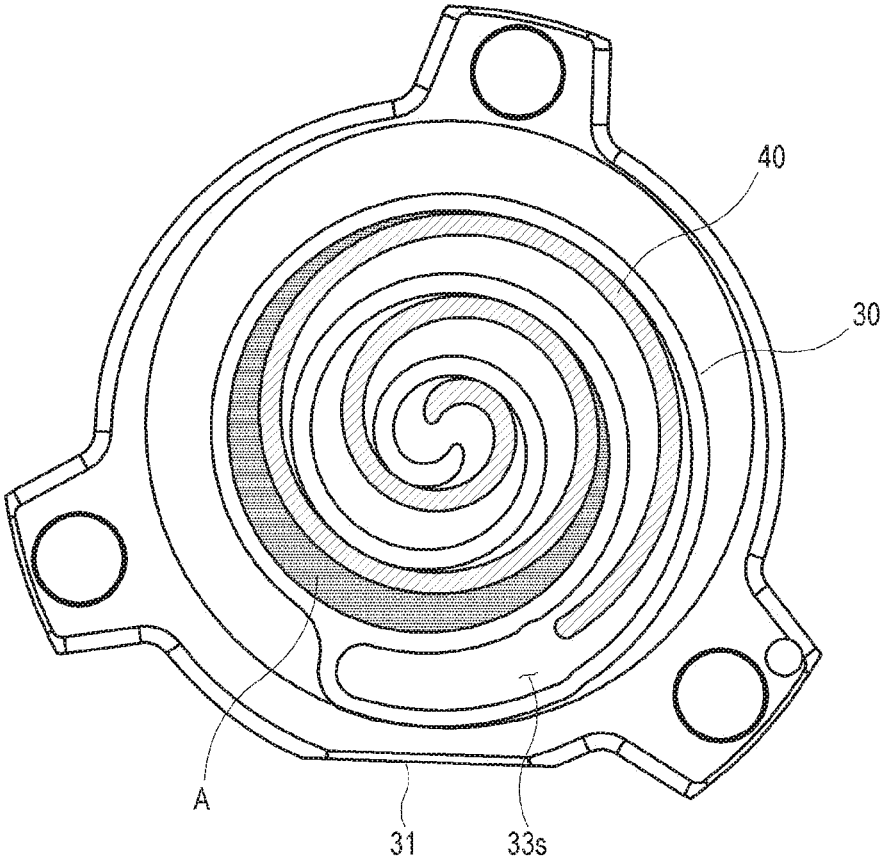

In FIG. 7, when the rotating scroll 40 rotates in the spiral compression compartment 33S, the space between the rotating scroll 40 and the stationary scroll 30 narrows at the outer portion, and widens at the center portion. As a result, the filled medium A of FIG. 6 is moved toward the center in a spiral direction while being compressed.

Figure 8:
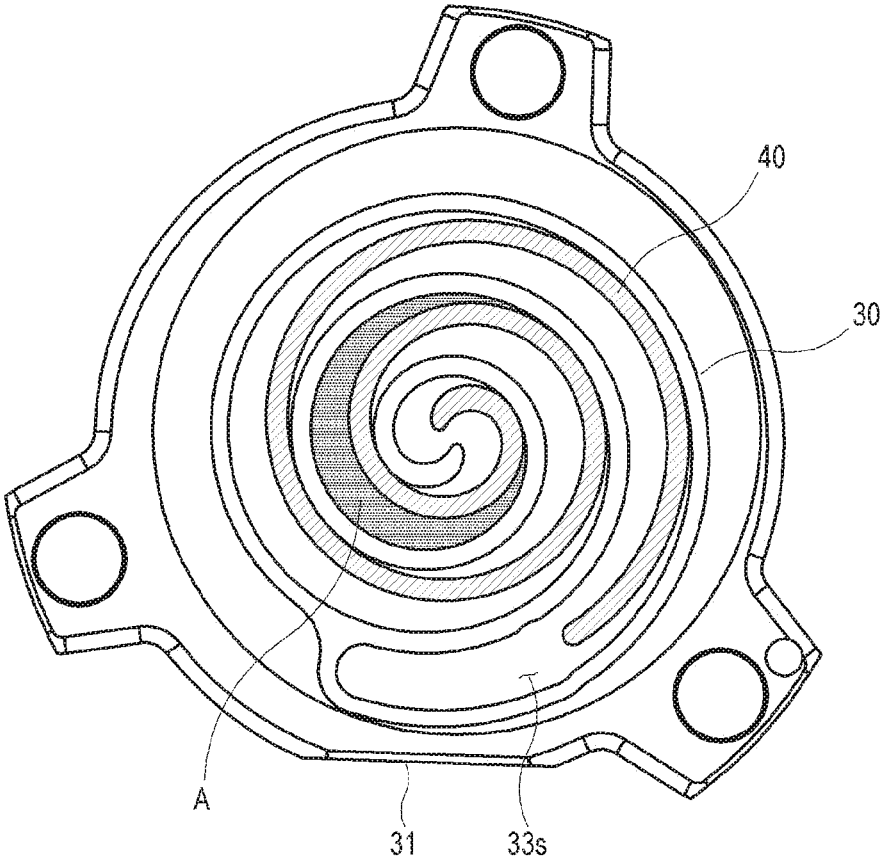

In FIG. 8, as the rotating scroll 40 repeats rotating, the medium A is continuously moved toward the center in a spiral direction like in FIG. 7.

Figure 5:
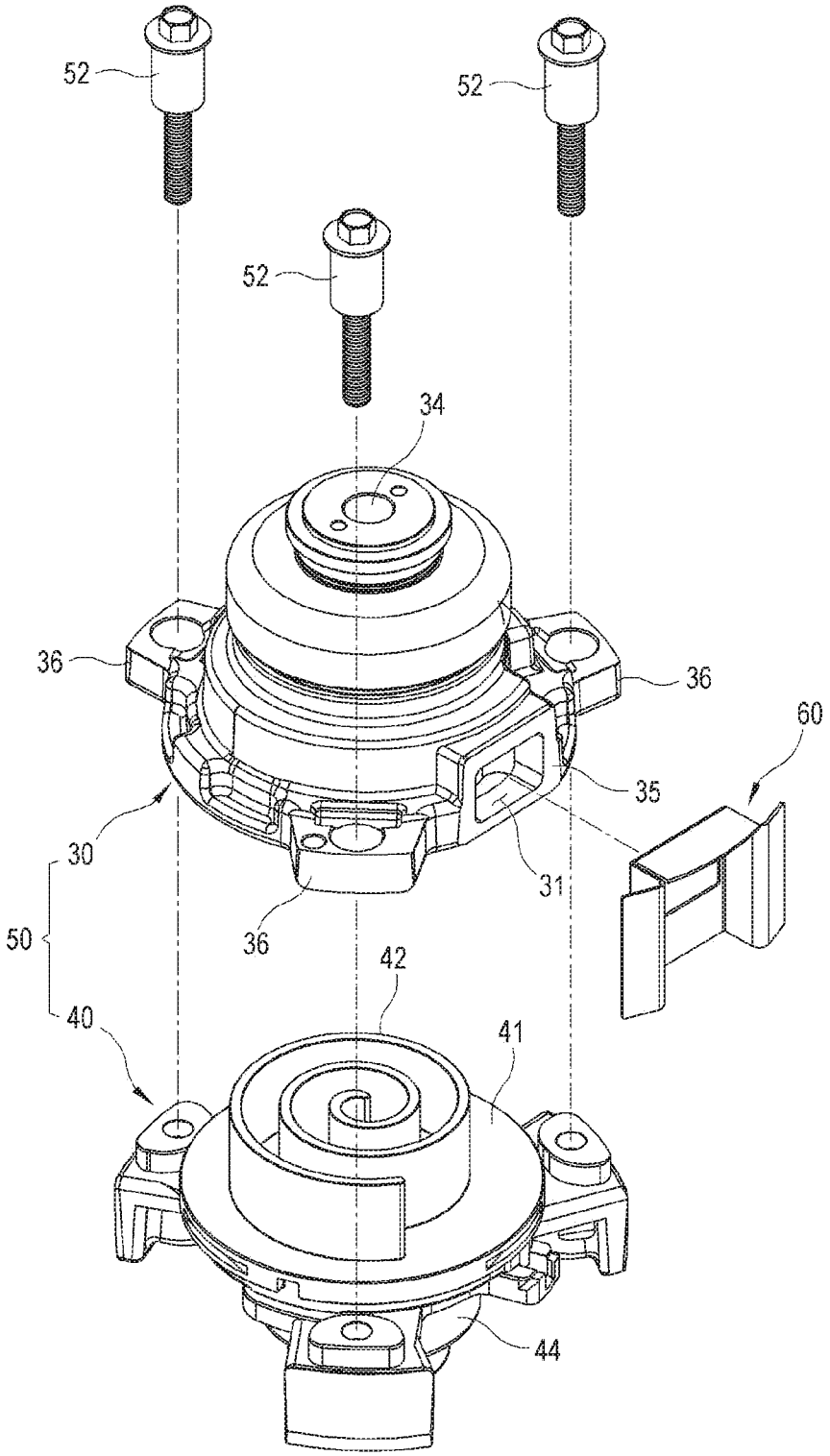
Figure 9:
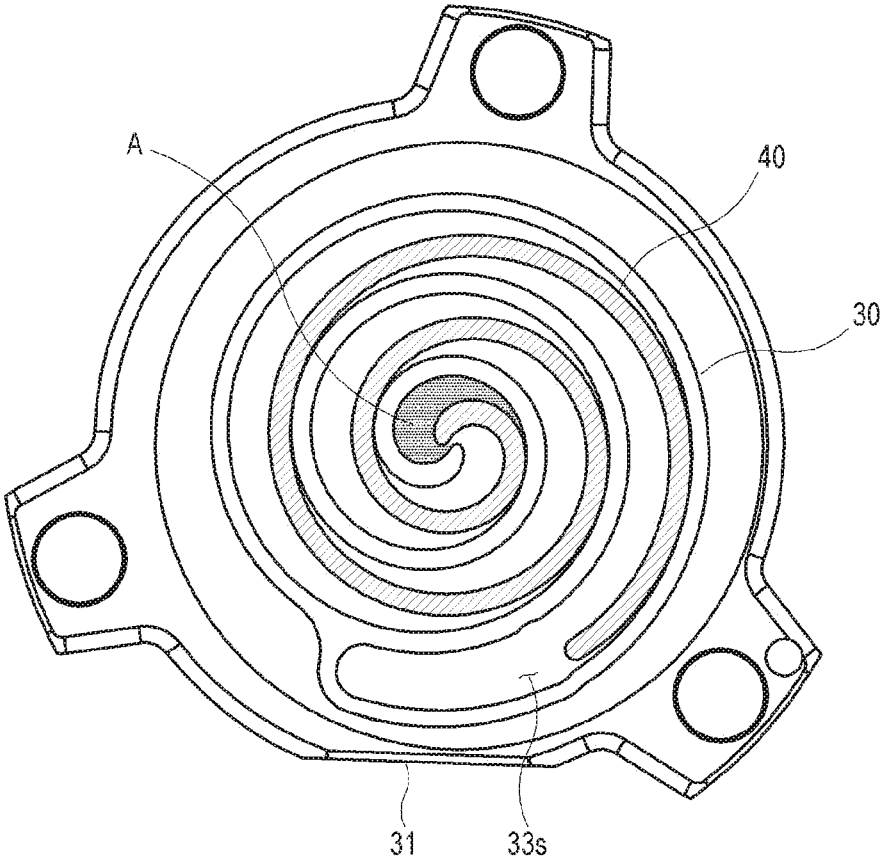

In FIG. 9, the rotating scroll 40 rotates until the medium A reaches the center, and then the medium A is discharged through the outlet 34 (see FIG. 5).

As described above, the medium A, which is sucked from the outside of the casing 10 into the inlet 31 through the suction guide 60, is gradually compressed moving toward the center due to repeated rotation of the rotating scroll 40.

Figure 10:
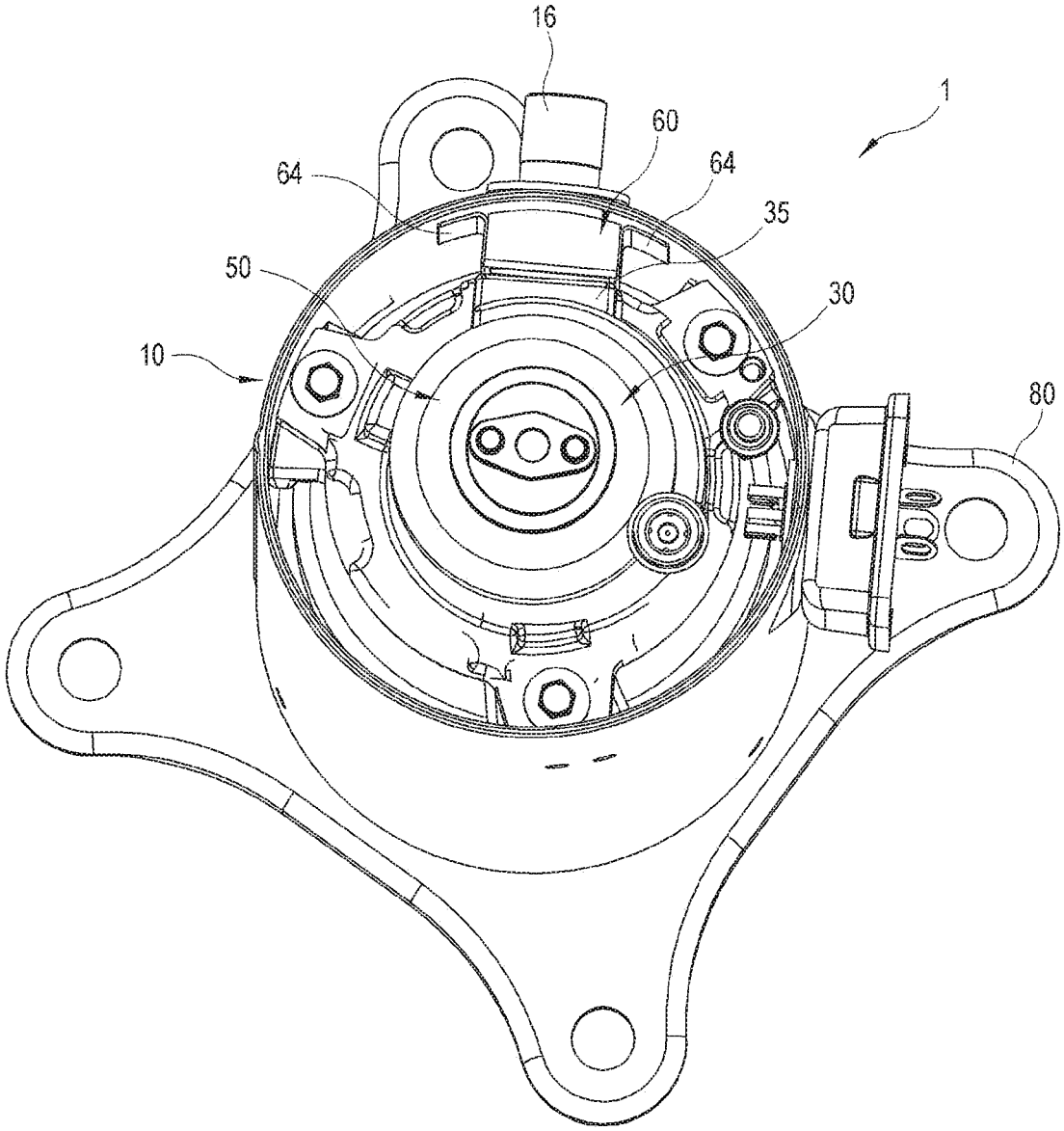
FIG. 10 is a perspective view showing a compression unit accommodated in the casing of the compressor.

FIG. 10 shows the suction guide 60 installed in the suction portion 35 of the stationary scroll 30. As shown in the drawing, the suction guide 60 is coupled, for example, welded, onto the internal wall of the casing 10. In the manufacturing process, the compression unit 50 is inserted in the state that the suction guide 60 is coupled on the internal wall of the casing 10 so that a vent 61 (see FIG. 12) of the suction guide 60 and the inlet 31 (see FIG. 11) of the stationary scroll 30 may be disposed to face each other.

Figure 11:
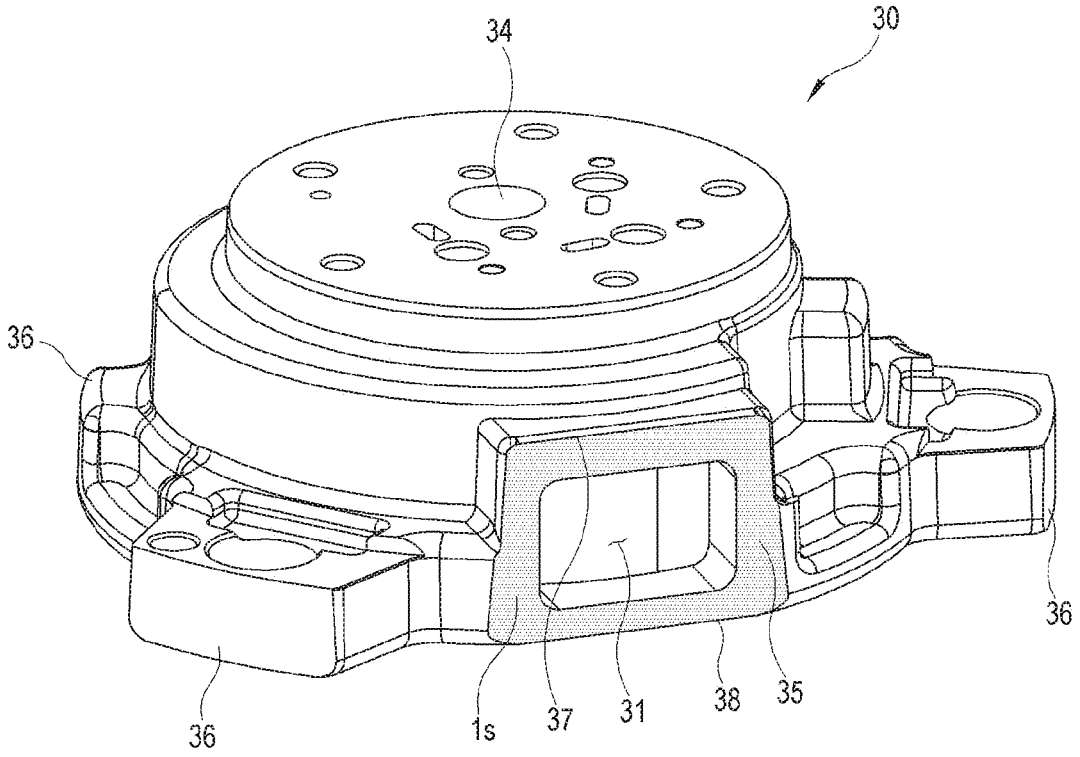
FIG. 11 is a perspective view showing a stationary scroll according to the first embodiment of the disclosure.

FIG. 11 is a perspective view the stationary scroll 30. The stationary scroll 30 includes the suction portion 35 formed on a side surface. The suction portion 35 has, for example, a quadrangular shape. The inlet 31 may be designed in any shape, such as a circle, an oval, a polygon, etc. The suction portion 35 protrudes from the circumferential surface in a radial direction. The protruding end of the suction portion 35 has a first surface 1S which is parallel to, for example, the direction of an axis "0" (see FIG. 3) (hereinafter, referred to as an "axial direction"). Because the protruding end of the suction portion 35 has the first surface 1S parallel to the axial direction, the compression unit 50 may be inserted without interference of the suction guide 60 in the manufacturing process of inserting the compression unit 50 into the casing 10 in which the suction guide 60 has been installed. This will be described in detail below. According to another embodiment, the protruding end of the suction portion 35 may have an inclined surface so that an external end 37 in the axial direction is closer to the axis 0 than an internal end 38. Due to this structure, the compression unit 50 may be inserted without interference of the suction guide 60 in the manufacturing process. In this embodiment, however, the lower end of the casing 10 is open, and the compression unit 50 is inserted from the lower end of the casing 10. In another embodiment having a structure in which the upper end of the casing 10 is open and the compression unit 50 is inserted from the upper end of the casing 10, the protruding end of the suction portion 35 may have a surface inclined upside down.

The first surface 1S has a single surface which extends from the edge boundary of the inlet 31. The first surface 1S may be a curved surface or a complex surface. The suction portion 35 may include a first taper portion which is inclined toward the axis 0 at the internal end 38. Due to this structure, the convenience of operation is further improved in the manufacturing process of inserting the compression unit 50 into the casing 10. As necessary, the suction portion 35 may include a taper portion which is inclined toward the axis 0 at the external end 37 of the first surface 1S.

Figure 12:
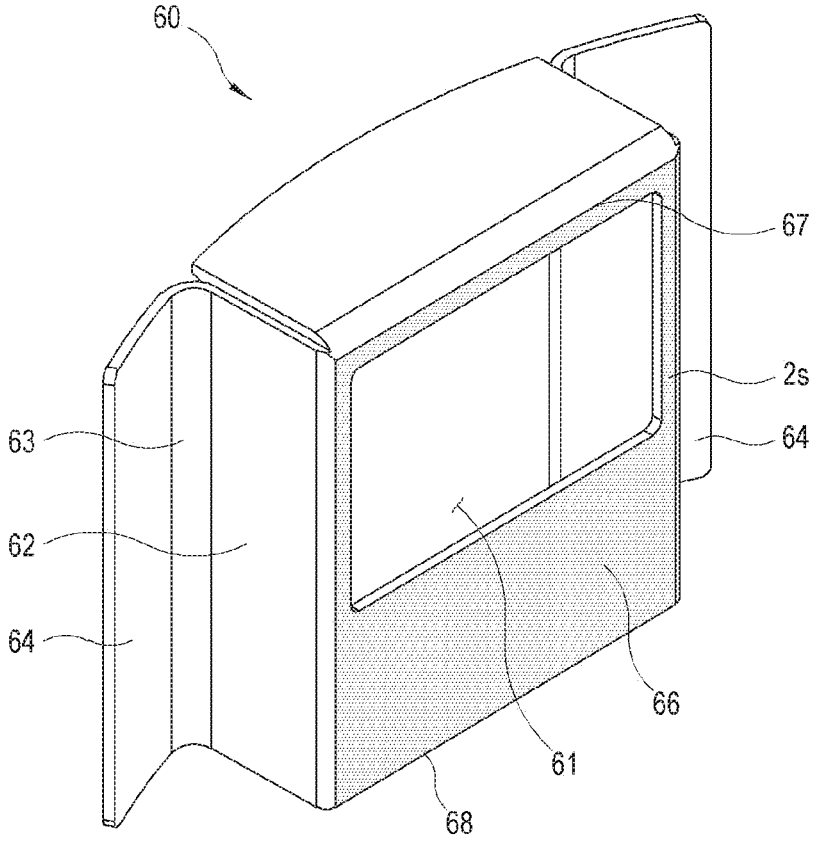
FIGS. 12 and 13 are perspective views showing front and back sides of a suction guide according to the first embodiment of the disclosure.
Figure 13:
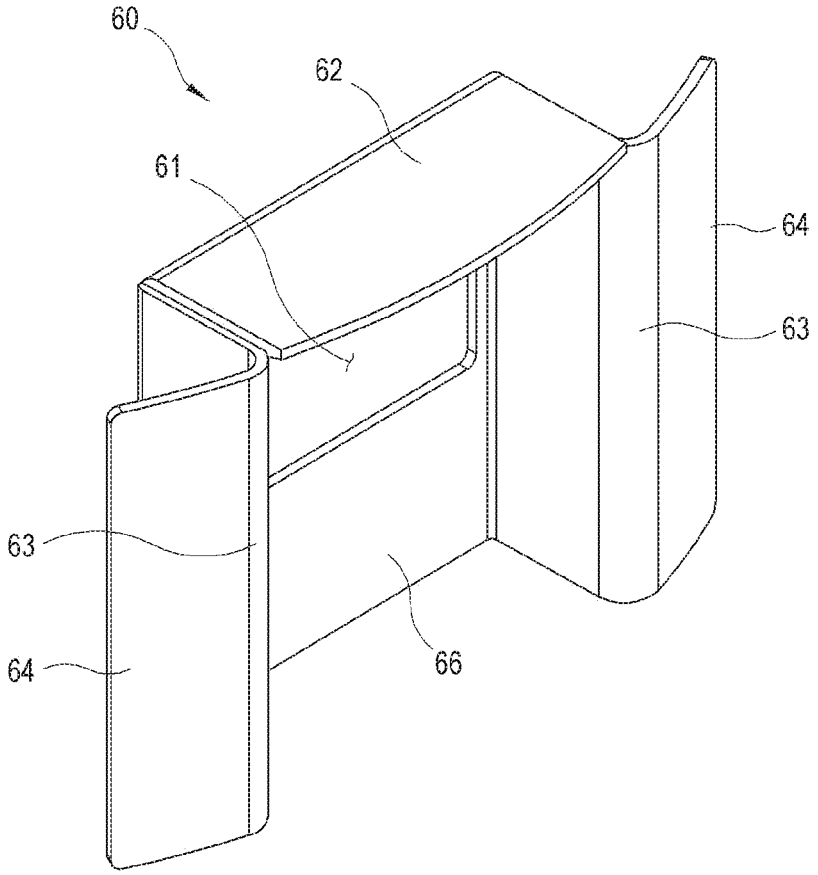

FIGS. 12 and 13 are perspective views showing front and back sides of the suction guide 60. The suction guide 60 includes a guide body 62 in, for example, a quadrangular box shape and one pair of wings 64 extending from the left and right back edges of the guide body 62. The guide body 62 includes a front wall 66 having the vent 61 for discharging gas flowing in from the outside. The front wall 66 has a second surface 2S extending from the edge of the vent 61. The second surface 2S is disposed to face the first surface 1S of the suction portion 35 of the stationary scroll 30. The second surface 2S is substantially parallel to the axial direction Because the second surface 2S is parallel to the axial direction, the compression unit 50 may be inserted without interference of the suction guide 60 in the process of inserting the compression unit 50 into the casing 10 in which the suction guide 60 has been installed. In another embodiment, the second surface 2S of the front wall 66 may have an inclined surface so that an external end 67 in the axial direction is closer to the axis 0 than an internal end 68. In this embodiment, however, the lower end of the casing 10 is open, and the compression unit 50 is inserted from the lower end of the casing 10. In another embodiment having a structure in which the upper end of the casing 10 is open and the compression unit 50 is inserted from the upper end of the casing 10, the second surface 2S may be inclined upside down. The second surface 2S may have a second taper portion inclined toward the axis 0 at the internal end 68.

The rear of the suction guide 60 is opened. Therefore, when the suction guide 60 is installed on the internal wall of the casing 10, the internal wall of the casing 10 serves as the back wall.

The wings 64 are coupled to the guide body 62 through connecting units 63. The connecting units 63 are bent from the left and right back edges of the guide body 62 at a predetermined angle and extend. The connecting unit 63 may have slight elasticity so that the guide body 62 can be elastically pushed back. The wings 64 may be coupled to the internal wall of the casing 10, for example, by welding. The wings 64 have a curvature similar to that of the internal wall of the casing 10. The wings 64 are coupled to the casing 10 at only end portions, while spacing the other portions apart from the casing 10 so that the guide body 62 may be additionally provided with elasticity.

As described above, the suction guide 60 has a simple structure and may be easily manufactured with metal by press work. Also, the suction guide 60 formed of metal has superior durability to conventional injection molded plastic and can be welded to the casing 10 formed of metal.

Figure 14:
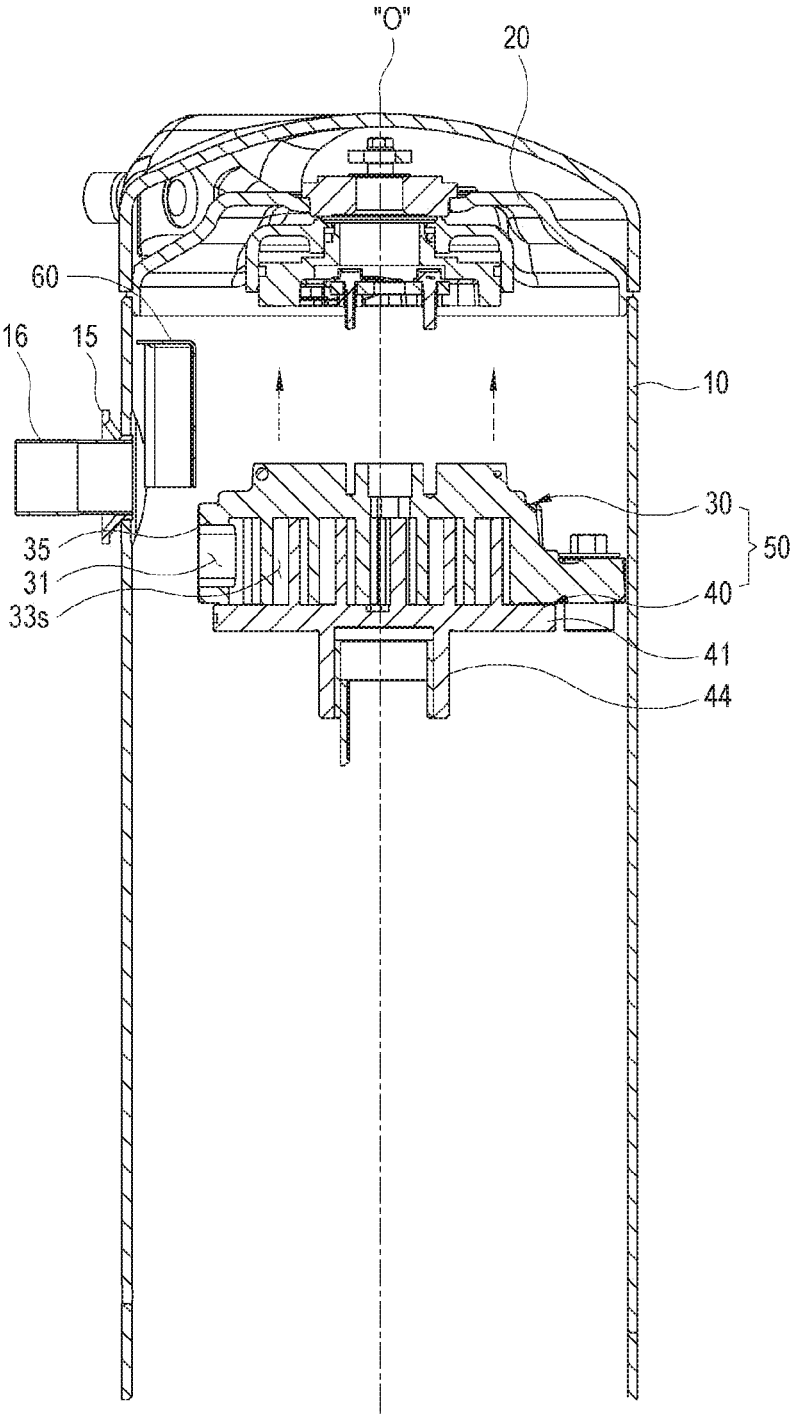
FIG. 14 is a partial cross-sectional view showing a process of coupling the compression unit to the suction guide according to the first embodiment of the disclosure.

FIG. 14 is a cross-sectional view showing a process of inserting the compression unit 50 from the lower end of the casing 10 in which the suction guide 60 is coupled according to the first embodiment of the disclosure.

The motor 70 is previously installed in the casing 10 in the axial direction, and the suction guide 60 is previously installed on the internal wall of the casing 10. The suction guide 60 is previously coupled at a position corresponding to the gas suction tube 16 of the casing 10, for example, by welding. Subsequently, the compression unit 50 is inserted into the casing 10 through the lower opening. In this case, the compression unit 50 is inserted into the casing 10 inverted with the lower opening facing upward. Due to this assembling of the compression unit 50, the inlet 31 of the suction portion 35 and the vent 61 of the suction guide 60 are disposed to face each other. In this casing, the external end (see "37" in FIG. 11) of the first surface 1S of the suction portion 35 and the internal end (see "68" in FIG. 12) of the second surface 2S of the suction guide 60 should not overlap at least in the axial direction so that the compression unit 50 can be inserted. In other words, when any one of the first surface 1S and the second surface 2S approaches the other in the axial direction, the two surfaces should not catch each other so that the first surface 1S and the second surface 2S can be closely disposed to face each other. In this way, simply assembling the compression unit 50 may automatically cause the inlet 31 of the suction portion 35 and the vent 61 of the suction guide 60 to close and face each other. As a result, a worker does not need to install the suction guide 60 after assembling the compression unit 50, and thus workability is high. Also, because it is possible to design the suction guide 60 in a simple structure, the suction guide 60 can be manufactured with metal by press work, and the durability may be improved. Further, because the structure of the suction guide 60 is simplified, the design of a gas flow channel is simplified, and compressor efficiency is improved with increase in a channel area.

In FIG. 14, the compression unit 50 may be assembled by directly inserting the compression unit 50 into the casing 10 or moving the upper portion of the casing 10 close to the inverted compression unit 50 and inserting the compression unit 50.

The external end 37 of the first surface 1S of the suction portion 35 and the internal end 68 of the second surface 2S of the suction guide 60 may have the first taper portion and the second taper portion, respectively. Even when the first taper portion and the second taper portion slightly overlap in the axial direction due to a mechanical tolerance of the suction guide 60 or the stationary scroll 30 or due to a coupling position error of the suction guide 60 caused by a worker, the suction guide 60 may be pushed back due to the elasticity of the connecting units (see "63" in FIG. 12) so that the compression unit 50 can be easily assembled.

Figure 15:
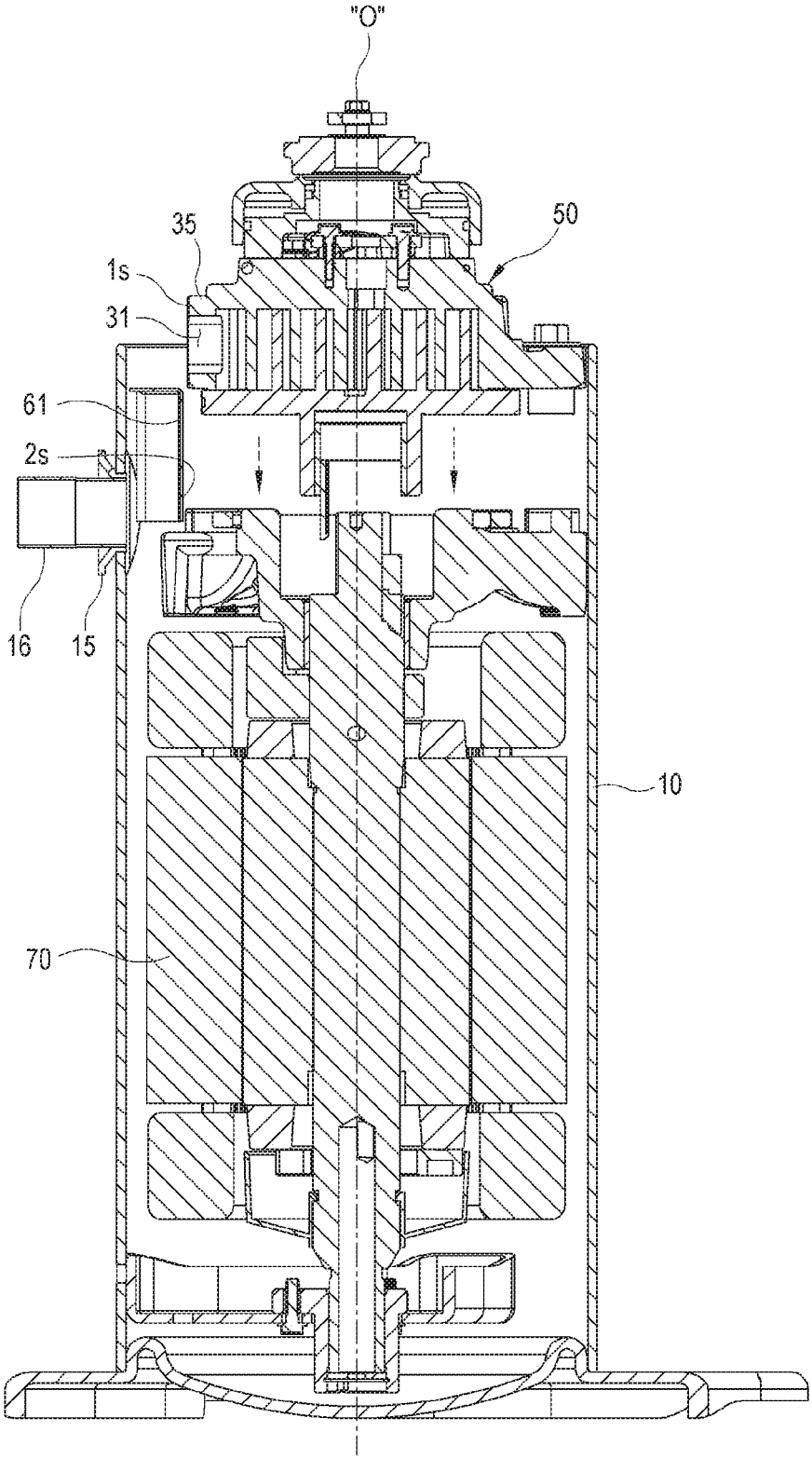
FIG. 15 is a partial cross-sectional view showing a process of coupling a compression unit to a suction guide according to a second embodiment of the disclosure.

FIG. 15 is a cross-sectional view showing a process of inserting a compression unit 50 from the upper end of a casing 10 in which a suction guide 60 is coupled according to a second embodiment of the disclosure.

A motor 70 is previously installed in the casing 10 in an axial direction, and the suction guide 60 is previously installed on the internal wall of the casing 10. The suction guide 60 is previously coupled a position corresponding to a gas suction tube 16 of the casing 10, for example, by welding. Subsequently, the compression unit 50 is inserted into the casing 10 through the upper opening. Due to this assembling of the compression unit 50, an inlet 31 of a suction portion 35 and a vent 61 of the suction guide 60 are disposed to face each other. In this case, an internal end (see "38" in FIG. 11) of a first surface 1S of the suction portion 35 and an external end (see "67" in FIG. 12) of a second surface 2S of the suction guide 60 should not overlap at least in the axial direction so that the compression unit 50 can be assembled. In other words, when any one of the first surface 1S and the second surface 2S approaches the other in the axial direction, the two surfaces should not catch each other so that the first surface 1S and the second surface 2S can be closely disposed to face each other. In this way, simply assembling the compression unit 50 may automatically cause the inlet 31 of the suction portion 35 and the vent 61 of the suction guide 60 to closely face each other.

According to embodiments of the disclosure, because an inlet boundary of a stationary scroll which comes in contact with a gas vent of a suction guide is planar, the gas vent boundary of the suction guide, which will be put together with the inlet boundary of the stationary scroll, can be also designed to be planar. In this way, as the gas vent of the suction guide is simplified in shape, the suction guide can be manufactured with metal by press work instead of plastic based on injection molding and can be directly welded to the casing. Therefore, the suction guide is improved in mechanical strength, and is thus prevented from damage when assembled or operating.

Also, in the compressor, the structure of a suction guide is simplified. Therefore, the design of a gas flow channel is simplified, and efficiency is improved with increase in a channel area.

Further, because it is possible to omit an operation of coupling the suction guide to the stationary scroll with a bolt, workability is improved.

Although a few exemplary embodiments have been shown and described, the disclosure is not limited to the specific embodiments set forth herein and can be modified in various ways by those skilled in the art without departing from the spirit of the disclosure defined in the claims. The modified embodiments should not be understood separately from the technical spirit and prospect of the disclosure.

What is claimed is:

1. A compressor comprising:

a stationary scroll including a suction portion that protrudes from the stationary scroll, and an outer surface of a protruding end of the suction portion defines a boundary of an inlet to intake gas into the stationary scroll, wherein the outer surface of the protruding end of the suction portion is formed in a first flat plane substantially perpendicular to a direction in which the gas is to be taken into the inlet;

a rotating scroll configured to rotate in the stationary scroll;

a casing configured to accommodate the stationary scroll; and a suction guide connected to the casing and including a guide body providing a passage, and the guide body has a surface forming a wall, and the surface forming the wall defines a boundary of a vent of the suction guide, so that the suction guide is configured to guide the gas from an outside of the casing through the passage and then through the vent to be taken into the inlet, wherein the surface forming the wall is formed in a second flat plane substantially perpendicular to a direction in which the gas passes through the passage, and is configured to face the outer surface of the protruding end of the suction portion.

2. The compressor according to claim 1, wherein the suction portion protrudes from the stationary scroll in a radial direction from an axis of rotation of the stationary scroll.

3. The compressor according to claim 1, wherein the suction guide is coupled to the casing.

4. The compressor according to claim 3, wherein the stationary scroll is accommodated in the casing in a state that the suction guide is coupled to the casing.

5. The compressor according to claim 3, wherein the suction guide comprises:

at least one wing connected to the guide body and configured to be connected to the casing.

6. The compressor according to claim 5, wherein the at least one wing supports the guide body to elastically bias the guide body in a direction away from the inlet.

7. The compressor according to claim 5, wherein the at least one wing comprises a pair of wings respectively connected to left and right sides of the guide body.

8. The compressor according to claim 5, wherein the at least one wing is configured to be welded to the casing.

9. The compressor according to claim 1, wherein the outer surface of the protruding end of the suction portion comprises a taper portion inclined toward an axis of rotation of the stationary scroll to guide an insertion of the stationary scroll into the casing.

10. The compressor according to claim 1, wherein the surface forming the wall comprises a taper portion inclined away from an axis of rotation of the stationary scroll to guide an insertion of the stationary scroll into the casing.

11. The compressor according to claim 1, wherein the outer surface of the protruding end of the suction portion is a single surface, and the surface forming the wall is a single surface.

12. The compressor according to claim 1, wherein the stationary scroll forms a spiral compression compartment, and the rotating scroll is inserted in and rotatable in the spiral compression compartment around an axis of rotation of the rotating scroll.

13. The compressor according to claim 12, wherein each of the stationary scroll and the rotating scroll comprises three flanges protruding radially from the axis of rotation of the rotating scroll.

14. The compressor according to claim 13, wherein the inlet is positioned between two adjacent flanges of the three flanges of the stationary scroll.

15. A method of manufacturing a compressor comprising a stationary scroll including a suction portion that protrudes from the stationary scroll, and an outer surface of a protruding end of the suction portion defines a boundary of an inlet to intake gas into the stationary scroll, wherein the outer surface of the protruding end of the suction portion is formed in a first flat plane substantially perpendicular to a direction in which the gas is to be taken into the inlet; a rotating scroll configured to rotate in the stationary scroll; a casing configured to accommodate the stationary scroll; and a suction guide connected to the casing and including a guide body providing a passage, and the guide body has a surface forming a wall, and the surface forming the wall defines a boundary of a vent of the suction guide, so that the suction guide is configured to guide the gas from an outside of the casing through the passage and then through the vent to be taken into the inlet wherein the surface forming the wall is formed in a second flat plane substantially perpendicular to a direction in which the gas passes through the passage, the method comprising:

coupling the suction guide to an internal wall of the casing; and after coupling the suction guide to the internal wall of the casing, inserting the stationary scroll into the casing so that the surface forming the wall faces the outer surface of the protruding end of the suction portion.

16. An electronic device comprising a compressor, the compressor comprising:

a stationary scroll including a suction portion that protrudes from the stationary scroll, and an outer surface of a protruding end of the suction portion defines a boundary of an inlet to intake gas into the stationary scroll, wherein the outer surface of the protruding end of the suction portion is formed in a first flat plane substantially perpendicular to a direction in which the gas is to be taken into the inlet;

a rotating scroll configured to rotate in the stationary scroll;

a casing configured to accommodate the stationary scroll; and a suction guide connected to the casing and including a guide body providing a passage, and the guide body has a surface forming a wall, and the surface forming the wall defines a boundary of a vent of the suction guide, so that the suction guide is configured to guide the gas from an outside of the casing through the passage and then through the vent to be taken into the inlet, wherein the surface forming the wall is formed in a second flat plane substantially perpendicular to a direction in which the gas passes through the passage, and is configured to face the outer surface of the protruding end of the suction portion.

* * * * *